United States Patent [19]

Riegelman et al.

[11] Patent Number: 4,949,521

[45] Date of Patent: Aug. 21, 1990

[54] FRAME AND MUNTIN ASSEMBLY

[76] Inventors: Harry M. Riegelman; Steven P. Davis, both of c/o Dade Metals Corp. 200 NW. 22nd St., Miami, Fla. 33127-4811

[21] Appl. No.: 333,550

[22] Filed: Apr. 3, 1989

[51] Int. Cl.[5] ..... E06B 3/70

[52] U.S. Cl. ..... 52/456; 52/665

[58] Field of Search ..... 52/85, 456, 664, 665, 52/476, 455

[56] References Cited

U.S. PATENT DOCUMENTS

| | | | |
|---|---|---|---|
| 3,307,316 | 3/1967 | Gray | 52/507 |
| 3,686,814 | 8/1972 | Anderson | 52/456 |
| 4,437,284 | 3/1984 | Cribben et al. | 52/456 |
| 4,466,220 | 8/1984 | Lewkowitz | 52/456 X |
| 4,644,721 | 2/1987 | Bloomquist et al. | 52/456 |
| 4,652,472 | 3/1987 | Davies | 52/456 X |
| 4,845,911 | 7/1989 | Winston et al. | 52/456 |

FOREIGN PATENT DOCUMENTS

| | | | |
|---|---|---|---|
| 0177866 | 4/1986 | European Pat. Off. | 52/85 |
| 1034347 | 7/1958 | Fed. Rep. of Germany | 52/476 |

*Primary Examiner*—Richard E. Chilcot, Jr.
*Assistant Examiner*—Lan Mai
*Attorney, Agent, or Firm*—Oltman and Flynn

[57] ABSTRACT

A frame and muntin assembly for use in a window or with another thin panel for a building structure. In a window the frame has interconnected frame members extending along the periphery of the window pane and each having an elongated outwardly protruding segment located outside the periphery of the window pane and offset in front of it, an elongated blind groove between the outwardly protruding segment and the periphery of the window pane, and an elongated inwardly protruding segment offset behind the outwardly protruding segment and engaging the front of the window pane. Muntins extend across the front between different locations along the grooves and are attached to the frame members by fastener elements received in the grooves. The muntins are flush with the outwardly protruding segments of the frame members.

22 Claims, 3 Drawing Sheets

FIG. 1
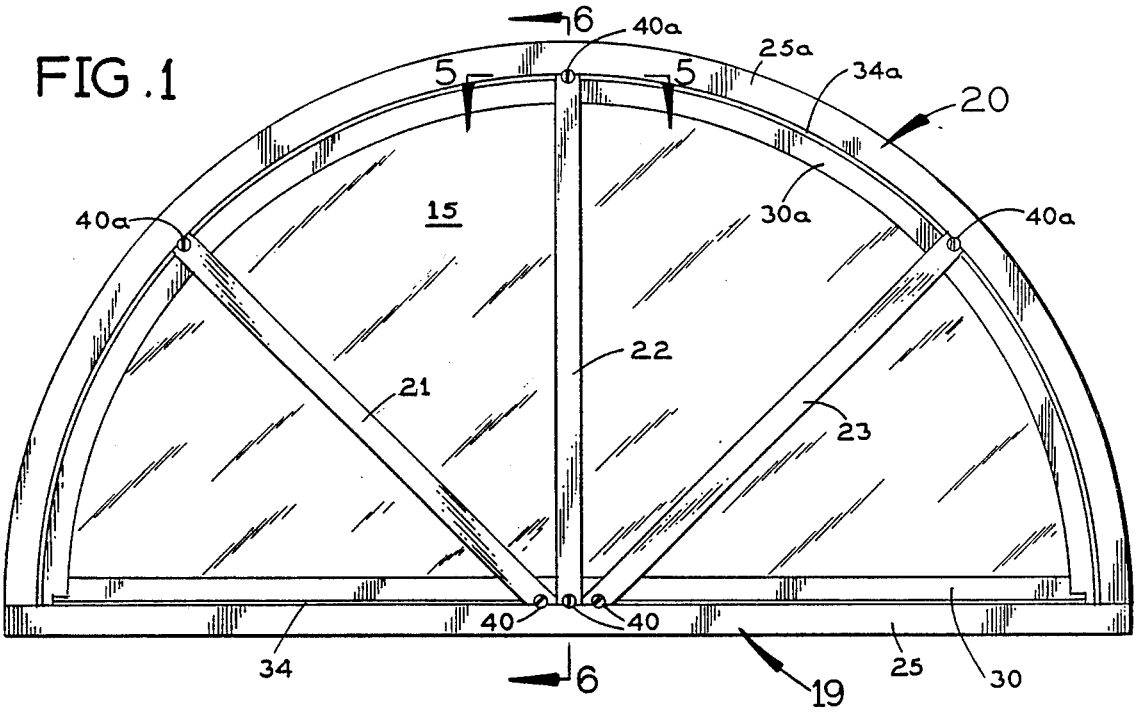
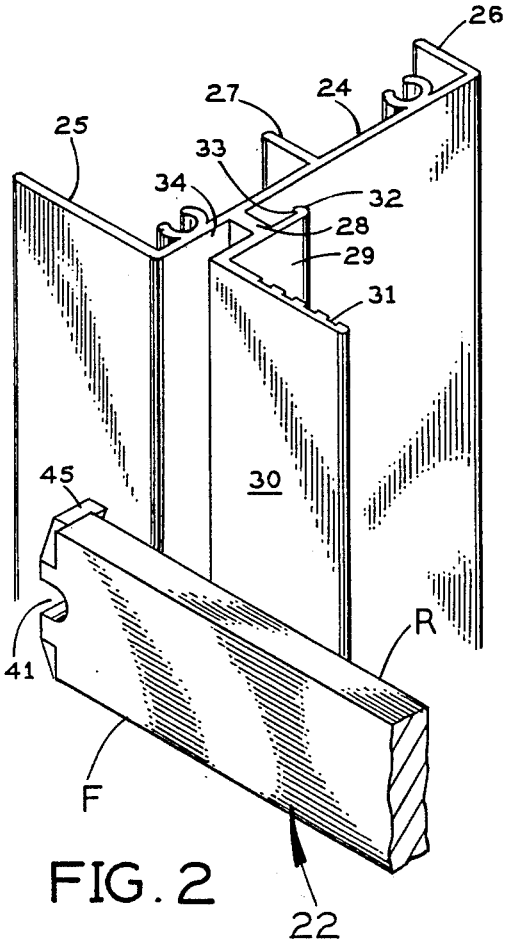
FIG. 2
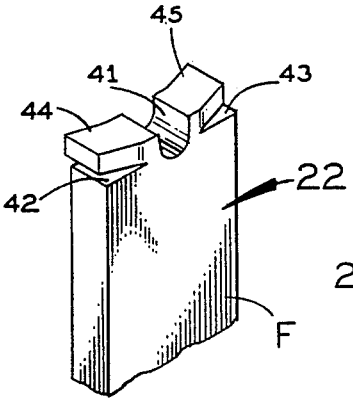
FIG. 3
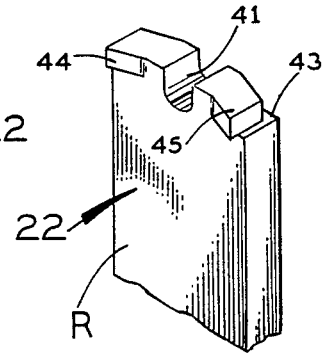
FIG. 4
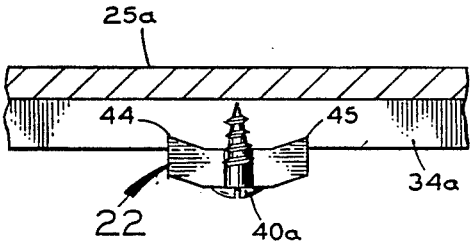
FIG. 5

FIG. 6
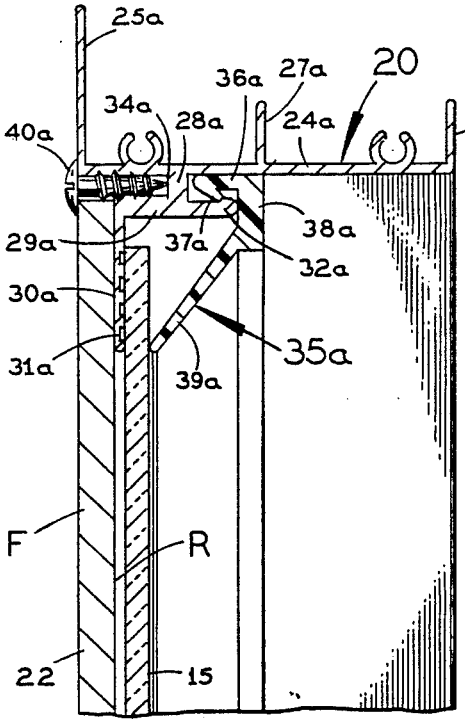
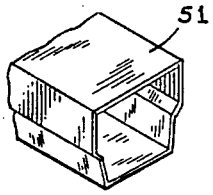
FIG. 8
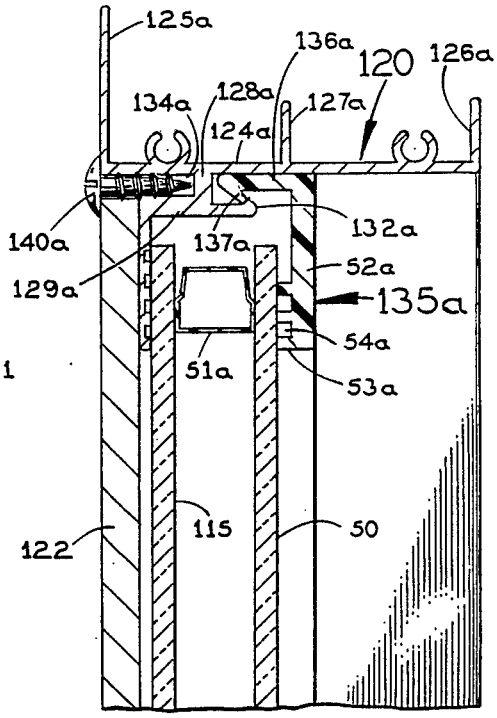
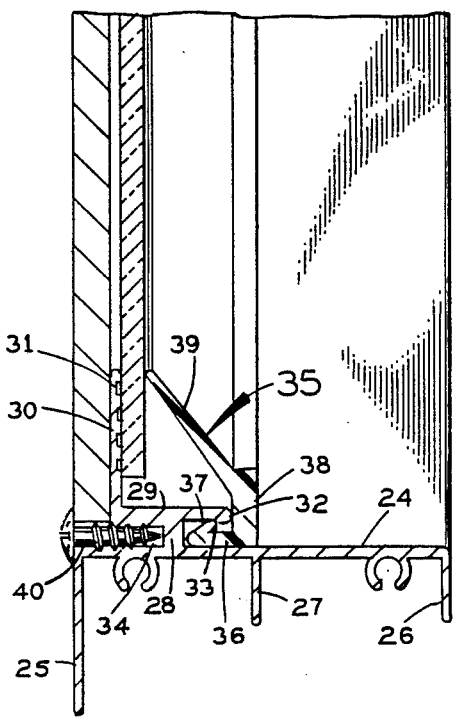
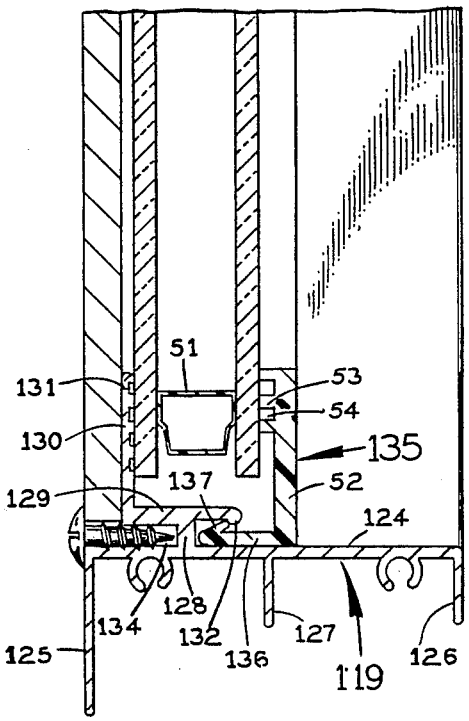
FIG. 7

FRAME AND MUNTIN ASSEMBLY

FIELD OF THE INVENTION

This invention relates to a frame and muntin assembly for use on thin panels, such as windown glass, and to a panel assembly embodying such a frame and muntin assembly.

BACKGROUND OF THE INVENTION

For centuries there have been windows with an outer frame and cross-pieces, called muntins, which separate individual panes of glass and are physically attached to them. Such muntins sometimes are called "true" muntins because they physically separate adjacent panes of glass. More recently, there have been windows with so-called "false" muntins or grids that are either glued or painted onto a large pane of glass to make it appear to be composed of smaller individual panes. Other expedients intended to provide the same visual effect have been grids extending across the inside of a large window pane and snapped in place in the outer frame of the window, and grids extending across the outside of a large window pane and attached to the outer frame by screws.

SUMMARY OF THE INVENTION

The present invention is directed to a novel frame and muntin assembly for use in a window or with another thin panel for a building structure to give the window pane or other panel the appearance of being divided into smaller neighboring panes.

A particular advantage of the present invention is that, when in place on the outer frame, the muntins are flush with the exposed surfaces of the frame.

Another advantage is that the outer frame has elongated grooves which enable the muntins to be positioned in a great variety of different ways extending across the window pane or other panel but without permitting air or water leakage through the frame. Another advantage is that the muntins are removable and interchangeable with other muntins.

Preferably, the present invention has a frame composed of substantially rigid frame members interconnected to extend around the window pane or other panel along its periphery. Each frame member has an outwardly protruding segment with an exposed first surface, a narrow blind groove which is open along the inside of this exposed surface, and an inwardly protruding segment extending inward from and offset behind the outwardly protruding segment. In use, the inwardly protruding segments of the frame members engage the front of a window pane or other thin panel along its periphery and the blind grooves in the frame members extend outside the periphery of the window pane or other panel. Muntins extend across the frame in front of the inwardly protruding segments of the frame members. The exposed front faces of the muntins are flush with the exposed front surfaces of the outwardly protruding segments of the frame members. Fasteners are received in the grooves in the frame members to hold the opposite ends of the muntins in place on the frame. Since there is only one light, glass replacement is easy and leakage is minimized.

A principal object of this invention is to provide a novel frame and muntin assembly for use in window or with another relatively thin panel for a building structure.

Another principal object of this invention is to provide a novel panel assembly for use on a building structure having such a frame and muntin assembly.

Further objects and advantages of this invention will be apparent from the following detailed description of several presently preferred embodiments, shown in the accompanying drawings.

DESCRIPTION OF THE DRAWINGS

FIG. 1 is an elevational view showing the outside of a semi-circular, single-glazed, picture window assembly embodying the present invention;

FIG. 2 is a fragmentary exploded perspective view shownin the sill and the middle muntin in this picture window assembly;

FIG. 3 is a fragmentary perspective view showing the outside of one end of the middle muntin in FIG. 1;

FIG. 4 is a similar view showing the inner side of this muntin;

FIG. 5 is a fragmentary horizontal longitudinal section taken along the line 5—5 in FIG. 1 where the middle muntin is attached to the head of the window frame;

FIG. 6 is a vertical cross-section taken along the line 6—6 in FIG. 1;

FIG. 7 is a view like FIG. 6 but showing a second embodiment of the invention in a double-glazed window;

FIG. 8 is a fragmentary perspective view of one of the spacers between the two panes of glass in FIG. 7;

Figure 9:
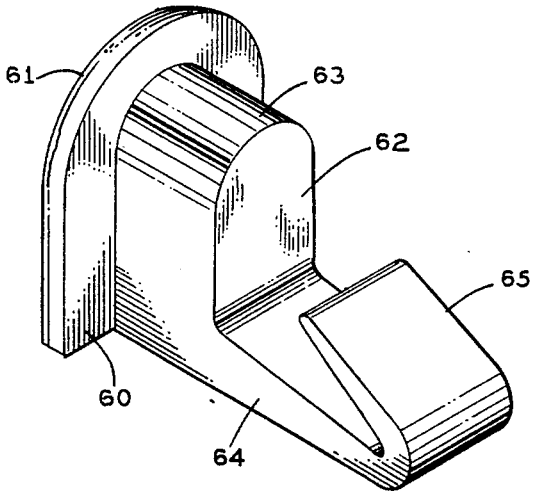
FIG. 9 is a perspective view of a muntin anchor, which may be used in place of a sheet metal screw to hold the muntin in each frame piece of the window assembly.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIG. 1, in broad outline the picture window assembly shown there has a single semi-circular pane of glass 15 held in a frame having a straight horizontally elongated sill 19 along the bottom and a semi-circular elongated head 20 along the top. The head 20 extends between and is rigidly attached to the opposite ends of the sill 19. On the outside, or front, of the window assembly the pane of glass is covered by three muntins or grids 21, 22 and 23 extending between sill 19 and head 20. The middle muntin 22 extends perpendicularly from the midpoint of sill 19 to the midpoint of head 20. The left and right muntins 21 and 23 extend from sill 19 on opposite sides of the middle muntin 22 to the head 20, making opposite 45 degree angles with the sill 19. From the outside, or front, of the window assembly the muntins seem to divide the single pane of glass 15 into four sectors of almost 45 degrees each.

FIG. 6 shows the cross-sectional shape of the sill 19 and of the head 20 along the entire length of each except where they are attached to one another. They have the same cross-section but facing in opposite directions so that each is a mirror image of the other.

Sill 19 has a flat horizontal cross wall 24, a front flange 25 on the outside extending perpendicularly down from cross wall 24 at its front edge, a rear flange 26 on the inner side extending perpendicularly down from cross wall 24 at its rear edge, and a middle flange 27 extending perpendicularly down from cross wall 24 midway between the front and rear flanges 25 and 26. The rear flange 26 is shorter vertically than the front flange 24. In the particular embodiment shown, the middle flange 27 has the same vertical dimension as the rear flange 26. However, the middle flange 27 may have a greater vertical dimension (i.e., perpendicular to the cross wall 24) than the front flange 25, if desired.

Sill 19 also has a short upstanding segment 28, which extends perpendicularly up from its cross wall 24 about midway between its front and middle flanges 25 and 27. An upper horizontal wall 29 is joined to segment 28 at the top and extends in front of and behind it parallel to the cross wall 24. An upper outside wall 30 extends perpendicularly up from wall 29 at its front edge. Wall 30 is offset a predetermined distance rearward from the front flange 25. The upper outside wall 30 has horizontal grooves 31 in its back face. The upper horizontal wall 29 has a rearwardly depending, vertically short lip 32 along its back edge which presents a forwardly-facing internal shoulder 33 extending perpendicular to the bottom face of wall 29.

In the window assembly, as best seen in FIG. 6, the front flange 25 of sill 19 is an outwardly protruding segment that is positioned outside the periphery of the window pane 15 and it presents an exposed front face offset in front of the window pane.

In cross-section the head 20 of the frame is a mirror image of sill 19. Corresponding elements of head 20 are given the same reference numerals as those of sill 19 but with an "a" suffix added. Head 20 differs from sill 19 in that its cross wall **24*a* and its lower wall 29*a* are both substantially half-cylinders, its front, rear and middle flanges 25*a*, 26*a* and 27*a* extend radially out from cross wall 24*a*, its segment 28*a* extends radially in from cross wall 24*a*, and its lower outside wall 30*a* extends radially in from its lower wall 29*a*** .

As shown in FIG. 2, the sill 19 of the frame has a horizontally elongated, vertically narrow, continuous blind groove 34 on the outside between its upper horizontal wall 29 and its cross wall 24 and in front of its upstanding segment 28. Groove 34 is open along the front of the sill immediately above its front flange 25 for its entire length between the opposite ends of head 20.

As best seen in FIG. 6, the upper outside wall 30 of sill 19 is an inwardly protruding segment that extends inward from groove 34 and is offset behind the front flange 25 by the front-to-back thickness of each muntin 21, 22 or 23.

Similarly, the head 20 of the frame has an elongated, vertically narrow, continuous, blind groove **34*a* on the outside extending in a semi-circle immediately below its upstanding front flange 25*a*. Groove 34*a* is located between the cross wall 24*a* and lower wall 29*a* and in front of segment 28*a* of head 20**.

Again referring to FIG. 6, a retainer member in the form of a glazing bead 35 is mounted on the sill 19 of the frame to hold the pane of glass 15 against the grooved back face of the upper outside wall 30 of the sill. Preferably, this glazing bead is a long polyvinyl chloride extrusion. The glazing bead has a flat bottom segment 36 directly overlying the cross wall 24 behind the upstanding segment 28 of sill 19. An upwardly and rearwardly inclined, tapered lip 37 on the glazing bead extends up from the front edge of its bottom segment 36 into engagement with the internal shoulder 33 at lip 32 on sill 19. The glazing bead has a relatively thick, rigid, back wall 38 extending up from its bottom segment 36 behind lip 32 on the sill, engaging the rear surface of that lip when the lip 37 of the glazing bead engages the internal shoulder 33 of the sill. The glazing bead has a flexible and resilient lip 39 which is inclined upward and forward from the upper end of the back wall 38 and engages the rear face of the window glass pane 15 in FIG. 6 at the level of the top edge of the upper front wall 30 of sill 19.

The head 20 of the frame supports a glazing bead **35*a* which is a mirror image of the glazing bead 35 on sill 19 except that it curves semi-circularly lengthwise in accordance with the curvature of head 20. Elements of the head's glazing bead 35*a* which correspond to those of the sill's glazing bead 35** have the same reference numerals but with an "a" suffix.

Except at the ends, each muntin 21, 22 and 23 in the window assembly has a rectangular cross-section, with flat front and rear faces and thinner flat end faces. As shown in FIG. 6 for the middle muntin 22, the flat rear face R of each muntin engages the flat front face of the upper outside wall 30 of the sill 19 and the corresponding lower outside wall **30*a* of the head 20 of the window frame. The front-to-back thickness of each muntin is equal to the distance that the front face of the front flange 25 of sill 19 is offset in front of the front face of its upper outside wall 30, and equal to the distance that the front face of the front flange 25*a* of head 20 is offset in front of the front face of its lower outside wall 30*a*. Therefore, the flat front face F of each muntin 21, 22 and 23 is coplanar with the exposed front faces of the front flanges 25 and 25*a* of sill 19 and head 20** of the window frame. Thus, on the outside (or front) of the window assembly all the exposed surfaces of the window frame and the muntins are co-planar.

As shown in FIG. 6 for the middle muntin 22, each muntin is held in place on the frame by a lower sheet metal screw 40, which is screw-threadedly received in the front groove 34 of sill 19, and an upper sheet metal screw **40*a*, screw-threadedly received in the front groove 34*a* of head 20. As shown in FIG. 2 for the middle muntin 22, the lower end of each muntin has a U-shaped recess 41 for passing the lower screw 40. Also, each muntin has a similar recess in its upper end for passing the upper screw 40*a***.

As shown in FIGS. 3–5 for the middle muntin 22, near each end the muntin is formed with narrow slits 42 and 43 extending in from its opposite end edges toward the u-shaped recess 41. Between each of these slits and its adjacent end, the muntin is bent rearward to provide tabs 44 and 45 which project behind the flat rear face R (FIG. 4) of the muntin. As shown in FIG. 5 for the upper end of the middle muntin 22, its tabs 44 and 45 project into the front groove **34*a* in the head 20 of the window frame. Likewise, the corresponding tabs on the lower end of the muntin project into the front groove 34 on the sill 19 of the window frame. The same is true of the tabs on each end of each of the other muntins 21 and 23**.

As is clear from FIG. 1, the lower end face of the left muntin 21 (on opposite sides of its groove 41 there) extends at a 45 degree angle to the longitudinal axis of this muntin so that when this muntin is in place its lower end face rests on the cross wall 24 of sill 19 in front of its upper front wall 30. This is also true of the right muntin 23. Each of the left and right muntins 21 and 23 has a short vertical, beveled inner edge that directly engages the adjacent end edge of the middle muntin 22, so that the lower screws 40 for the three muntins are as close to each other as practicable.

In this window assembly, the front flange 25 of sill 19 and the front flange 25a of head 20 are outwardly protruding segments of the frame which are positioned outside the periphery of the window pane 15 and are offset in front of the window pane. The upper outside wall 30 of sill 19 and the lower outside wall 30a of frame 20 are segments of the frame that are offset behind its outwardly protruding segments 25 and 25a and are engaged on the front by the muntins 21, 22 and 23 and engaged on the back by the front face of window pane 15.

With this arrangement, the muntins 21, 22 and 23 combine with the sill 19 and head 20 of the frame to present an aesthetically pleasing appearance because all of these parts are coplanar on the outside of the window assembly. At the same time, there is no air or water leakage through the frame because of the presence of the wall 28 in its sill 19 and the wall 28a in its head 20 behind their respective longitudinal grooves 34 and 34a which extend along the outside or front of the frame. Because these grooves are continuous, they make it possible to position muntins at any desired locations along the grooves, thus enabling a great variety of geometric designs to be obtained. For example, if desired, in FIG. 1 all three muntins 21, 22, 23 could extend perpendicular to the sill 19 at selected locations along it. It is to be understood that the frame may have a shape different from the semi-circular shape shown in FIG. 1—for example, a full circle, a quarter circle or various polygons with equal or unequal sides.

Also, it is to be understood that the present frame and muntin assembly may be used on a relatively thin panel other than a window pane, for example, an awning.

FIG. 7 shows a second embodiment of the invention in which the window assembly has two panes of glass. Elements of this embodiment which are identical to elements of the first embodiment are given the same reference numerals, plus 100, as those in FIGS. 1–6. The detailed description of these elements will not be repeated.

In FIG. 7 a second pane of glass 50 is positioned inside, or behind, the first pane of glass 115. A straight, elongated, hollow spacer 51 is engaged between the rear of the outside pane 115 and the front of the inside pane 50 a short distance above the upper horizontal wall 129 of the sill 119 of the frame. An elongated, arcuate, hollow spacer 51a is similarly engaged between two panes of glass near the head 120 of the frame.

The glazing bead 135 at the sill 119 differs from the glazing bead 35 in FIGS. 1–6 in that it has a back wall 52 of greater vertical extent than the back wall 38 of glazing bead 35. This back wall 52 has several forwardly-porjecting longitudinal ribs 53, separated by grooves 54, which engage the rear or inside face of the inner pane of glass 50.

The glazing bead 135a at the head 120 of the frame is a mirror image of bead 135 except that it extends lengthwise in an arc to match the curvature of head 120.

Figure 10:
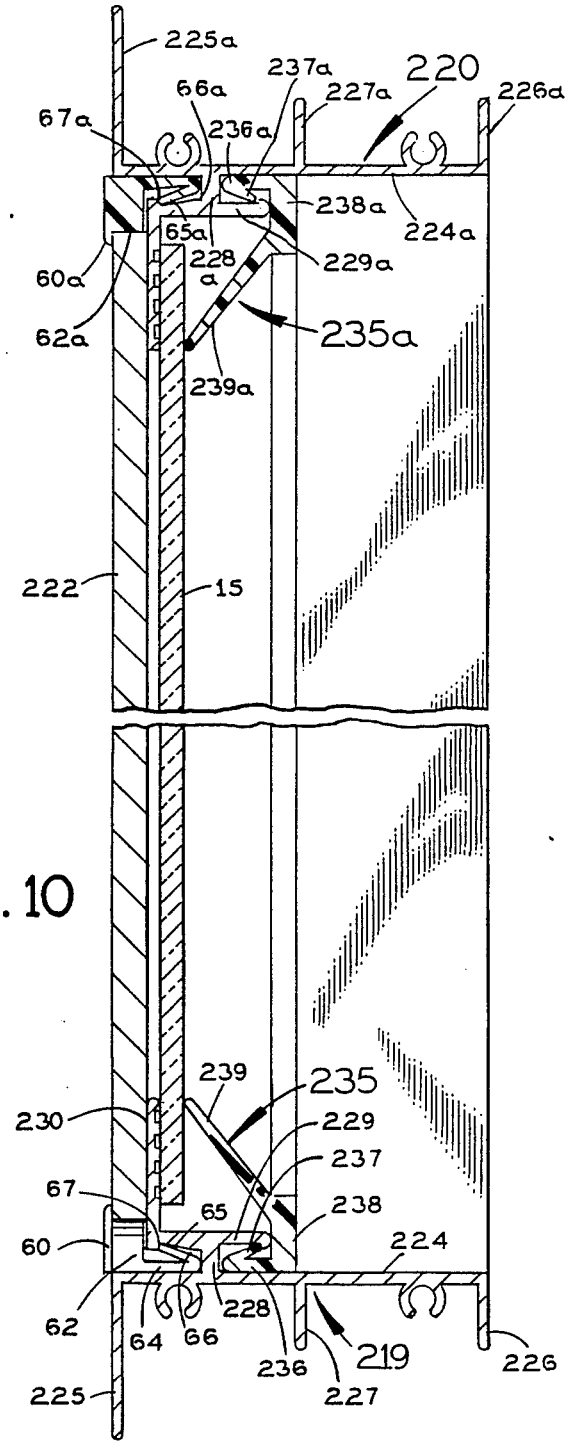
FIG. 10 is a view similar to FIG. 6 and showing a window assembly with muntin anchors as shown in FIG. 9.

FIG. 10 shows a third embodiment of the invention which is identical to the first embodiment (FIGS. 1–6) except that the screws 40 and 40a are replaced by plastic anchors as shown in FIG. 9 and the sill and head of the frame have a slightly modified construction to fit these anchors. Elements in FIG. 10 which correspond to those in FIGS. 1–6 are given the same reference numerals plus 200.

Each anchor has a flat outer wall 60 with a U-shaped peripheral edge 61, a smaller body segment 62 with a U-shaped peripheral edge 63 joined to the back of outer wall 60, a substantially straight leg 64 extending rearwardly from body segment 62 at its lower end and perpendicular to the outer wall 60, and a flexible and resilient lip 65 which is inclined upward and forward from the end of leg 64 remote from the outer wall 60.

As shown in FIG. 10, the body segment 62 of the anchor has a snug sliding fit in the end recess 241 in the corresponding muntin 222 (which corresponds to the recess 41 in the end of the muntin in FIGS. 2, 3 and 4). Around this end recess in the muntin, the outer wall 60 of the anchor engages the outer or front face of the muntin.

The cross wall 224 of sill 219 has a tapered recess or groove 66 on the bottom and it presents a rearwardly-facing, vertically short, internal shoulder 67 which is coplanar with the back face of the outside wall 230 of the sill. The lip 65 on the anchor fits snugly in this groove and engages internal shoulder 67 of the sill.

At the head 220 of the frame, the muntins are held in place by anchors which are mirror images of the anchor shown in FIG. 9. These anchors have the same reference numerals with an "a" suffix added. The head 220 has a tapered recess or groove 66a and an internal shoulder 67a which are mirror images of recess 66 and shoulder 67 on the sill 219.

From the foregoing, it will be evident that the muntin fastensers, either the screws or the plastic anchors shown in FIG. 9, can be inserted into the blind grooves in the frame anywhere along those grooves without the necessity of providing drilled holes in the frame to receive them. Also, these fasteners are readily removable from the frame to enable the muntins to be detached from the frame, when desired. The muntins are interchangeable with other muntins. The muntins can be of various shapes, and they may have decoration on their surface if desired. The panels may be operable if desired.

We claim:

1. A panel assembly for use on a building structure comprising:

a relatively thin panel having opposite first and second major faces;

a frame extending around said panel along its periphery and including substantially rigid frame members, each having an exposed surface located outside the periphery of said panel and offset from said first major face of said panel on the side of said first major face away from said second major face of said panel, and each of said frame members having a narrow blind groove which is open along said frame member next to said exposed surface and is elongated along the periphery of the panel, said groove being located outside the periphery of the panel and extending into the respective frame member transverse to said first major face of said panel;

a plurality of separate, disconnected muntins extending across said first major face of said and fasteners received in said grooves and attaching said muntins directly to said frame members.

2. A panel assembly according to claim 1 wherein:

each of said frame members has an outwardly protruding segment positioned outside the periphery of said panel and presenting said exposed surface offset from said first major face of said panel;

and said muntins extend across said first major face of said panel between said outwardly protruding segments of said frame members.

3. A panel assembly according to claim 2 wherein each of said muntins has an exposed surface that merges smoothly with said exposed surfaces of said frame members.

4. A panel assembly according to claim 3 wherein:

said major faces of said panel are flat;

said exposed surface of each of said frame members is flat and lies in a plane parallel to said major faces of said panel;

and said exposed surface of each of said muntins is flat and coplanar with said exposed surfaces of the frame members.

5. A panel assembly according to claim 4 wherein each of said frame members has an inwardly protruding segment extending inward from said groove and engaged between said first major face of the panel and the muntins attached to said frame member.

6. A panel assembly according to claim 5 and further comprising means acting between said frame members and said second major face of said panel to hold said panel in said frame.

7. A panel assembly according to claim 5 and further comprising panel retainer members seated respectively in said frame members and protruding therefrom into engagement with said second major face of said panel to hold said panel against said inwardly protruding segment of each frame member.

8. A panel assembly according to claim 5 and further comprising:

a second panel positioned behind said relatively thin panel;

spacers engaged between said panels;

and respective panel retainer members seated in said frame members and protruding inwardly therefrom into engagement with said second panel to hold said second panel against said spacers, to hold said spacers against said relatively thin panel, and to hold said relatively thin panel against said inwardly protruding segment of each frame member.

9. A panel assembly according to claim 1 and further comprising means acting between said frame members and said second major face of said panel to hold said panel in said frame.

10. A panel assembly according to claim 1 wherein each of said frame members has an inwardly protruding segment extending inward from said groove and engaged between said first major face of the panel and the muntins attached to said frame member.

11. A panel assembly according to claim 10 and further comprising means acting between said frame members and said second major face of said panel to hold said panel against said inwardly protruding segment of each frame member.

12. A window assembly comprising:

a pane of glass having flat opposite first and second major faces;

a frame surrounding said pane along its periphery and comprising substantially rigid frame members which are elongated along the periphery of said pane and each having:

an outwardly protruding segment positioned outside the periphery of said pane and presenting an exposed flat front surface that is offset in front of said first major face of said pane;

a narrow blind groove which is open along said frame member next to said exposed front surface of said outwardly protruding segment and extends lengthwise of the corresponding frame member, said groove being located outside the periphery of said pane and extending into the respective frame member substantially perpendicular to said first major face of said pane;

and an inwardly protruding segment extending inward from said groove and offset in back of said exposed front surface of said outwardly protruding segment and engaging said first major face of said pane;

a plurality of separate, disconnected muntins extending across said first major face of said pane between different locations along said grooves in said frame members, each of said muntins at its opposite ends engaging said inwardly protruding segments of said frame members, and each of said muntins presenting an exposed flat front surface substantially coplanar with said front surface of said outwardly protruding segment of each frame member;

and fasteners received in said grooves in said frame members and attaching the opposite ends of said muntins to said frame members.

13. A window assembly according to claim 12 and further comprising means acting between said frame members and said second major face of said pane to hold said pane in said frame.

14. A window assembly according to claim 12 and further comprising retainer members seated respectively in said frame members and protruding therefrom into engagement with said second major face of said pane to hold said pane against said inwardly protruding segment of each frame member.

15. A window assembly according to claim 12 and further comprising:

a second pane of glass positioned behind said first-mentioned pane;

spacers engaged between said panes;

and respective retainer members seated in said frame members and protruding inwardly therefrom into engagement with said second pane to hold said second pane against said spacers, to hold said spacers against said first-mentioned pane, and to hold said first-mentioned pane against said inwardly protruding segment of each frame member.

16. A frame and muntin assembly for use on a relatively thin panel for a building structure, said assembly comprising:

substantially rigid frame members interconnected to form a frame extending around the panel along its periphery, each of said frame members having a laterally inward side and an opposite laterally outward side with an outwardly protruding segment with an exposed surface, and each of said frame members having a narrow blind groove which is open along the laterally inward side of said exposed surface and is elongated lengthwise of said frame member;

a plurality of separate, disconnected muntins extending laterally inward from said outwardly protruding segments of said frame members across said frame between different locations along said grooves in said frame members;

and fasteners received in said grooves and attaching said muntins to said frame members.

17. A frame and muntin assembly according to claim 16 wherein each of said muntins has an exposed surface that merges smoothly with said exposed surfaces of said outwardly protruding segments of said frame members.

18. A frame and muntin assembly according to claim 17 wherein:

said exposed surfaces of said outwardly protruding segments of said frame members are flat and coplanar;

and said exposed surface of each of said muntins is flat and coplanar with said exposed surfaces of said outwardly protruding segments of the frame members.

19. A frame and muntin assembly according to claim 18 wherein each of said frame members has an inwardly protruding segment extending laterally inward from said groove and engageable between one major face of the panel and the muntins which are fastened to said frame member.

20. A frame and muntin assembly according to claim 19 and further comprising panel retainer members seated respectively in said frame members behind said grooves and extending laterally inward behind said inwardly protruding segments.

21. A frame and muntin assembly according to claim 16 wherein each of said frame members has an inwardly protruding segment extending laterally inward from said groove and engageable between one major face of the panel and the muntins which are fastened to said frame member.

22. A frame and muntin assembly according to claim 21 and further comprising panel retainer members seated respectively in said frame members behind said grooves and extending laterally inward behind said inwardly protruding segments.

* * * * *